US005752401A

United States Patent [19]

MacDonald

[11] Patent Number: 5,752,401

[45] Date of Patent: May 19, 1998

[54] DOUBLE HOOK KEY RING ASSEMBLY

[76] Inventor: Sumner MacDonald, 44 Ballou Blvd., Bristol, R.I. 02809

[21] Appl. No.: 735,226

[22] Filed: Oct. 22, 1996

Related U.S. Application Data

[63] Continuation-in-part of Ser. No. 526,063, Sep. 9, 1995, abandoned.

[51] Int. Cl.[6] ..... A44B 15/00

[52] U.S. Cl. ..... 70/459; 70/456 R

[58] Field of Search ..... 70/456 R, 458, 70/459; 24/3.6; D3/207–210

[56] References Cited

U.S. PATENT DOCUMENTS

| | | | |
|---|---|---|---|
| 1,172,374 | 2/1916 | Leimer | 70/459 |
| 2,283,983 | 5/1942 | Gibson | 70/459 |
| 2,307,808 | 1/1943 | Segal | 70/459 X |
| 3,345,713 | 10/1967 | Gaupp | 24/3.6 X |
| 4,391,113 | 7/1983 | Jorgens | 70/459 |
| 4,776,191 | 10/1988 | MacDonald | 70/459 |
| 4,821,543 | 4/1989 | Scungio | 70/456 R |
| 4,984,442 | 1/1991 | Benson | 70/459 X |
| 5,177,989 | 1/1993 | Stillwagon | 70/456 R |
| 5,209,090 | 5/1993 | Stillwagon | 70/456 R |
| 5,457,946 | 10/1995 | Stillwagon | 70/456 R |

*Primary Examiner*—Suzanne Dino
*Attorney, Agent, or Firm*—Robert J. Doherty

[57] ABSTRACT

A key ring assembly with two ring-holding bodies each carried in a housing for rotatable movement relative to each other and to the housing and for axial movement of one body to expose for removal one ring pursuant to selective movement of the other body.

9 Claims, 6 Drawing Sheets

DOUBLE HOOK KEY RING ASSEMBLY

This is a Continuation-In-Part of my application Ser. No. 08/526,063 filed Sep. 9, 1995, now abandoned.

FIELD OF THE INVENTION

This invention relates to key ring assemblies, and more particularly to such assemblies in which are provided a housing and two rings, one removable and both preferably rotatable relative to the housing, in a pair of cooperating body members also both preferably rotatable relative to the housing and to each other.

BACKGROUND OF THE INVENTION

Key ring assemblies in which a ring is rotatable relative to a housing are known in the art. Also so known are such assemblies in which a separate ring is selectively detachable from the housing.

SUMMARY OF THE INVENTION

It has been discovered that a useful key ring assembly simply and inexpensively made may be provided by mounting a pair of longitudinally spaced body portions for at least axial and preferably also rotational movement in a housing, one body portion being biased away from one end of the housing, and the other body portion being pushable from outside the housing to push the one body portion which has a ring retainer hook to expose the hook opening outside the housing, for release of the ring mounted thereon. Indeed, it has been discovered that a key ring hook may be provided which is mounted in a housing for both movement relative thereto to expose the hook for removal therefrom of a key ring, but for relative rotation between the hook and the housing as well.

In a preferred embodiment, both body portions terminate in hooks extending longitudinally outwardly of said housing, the body portions are interconnected for relative rotational movement and limited relative axial longitudinal movement, and one body portion is latched to said housing by a Nylon ring engaging a circumferential inner housing groove or otherwise restrained from axial movement by abutting the rear surface of a flange which in turn includes a forward surface which contacts the rear of the first body.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Structure and operation of the embodiment shown in FIGS. 1–6 are now described.

1. Structure

Figure 1:
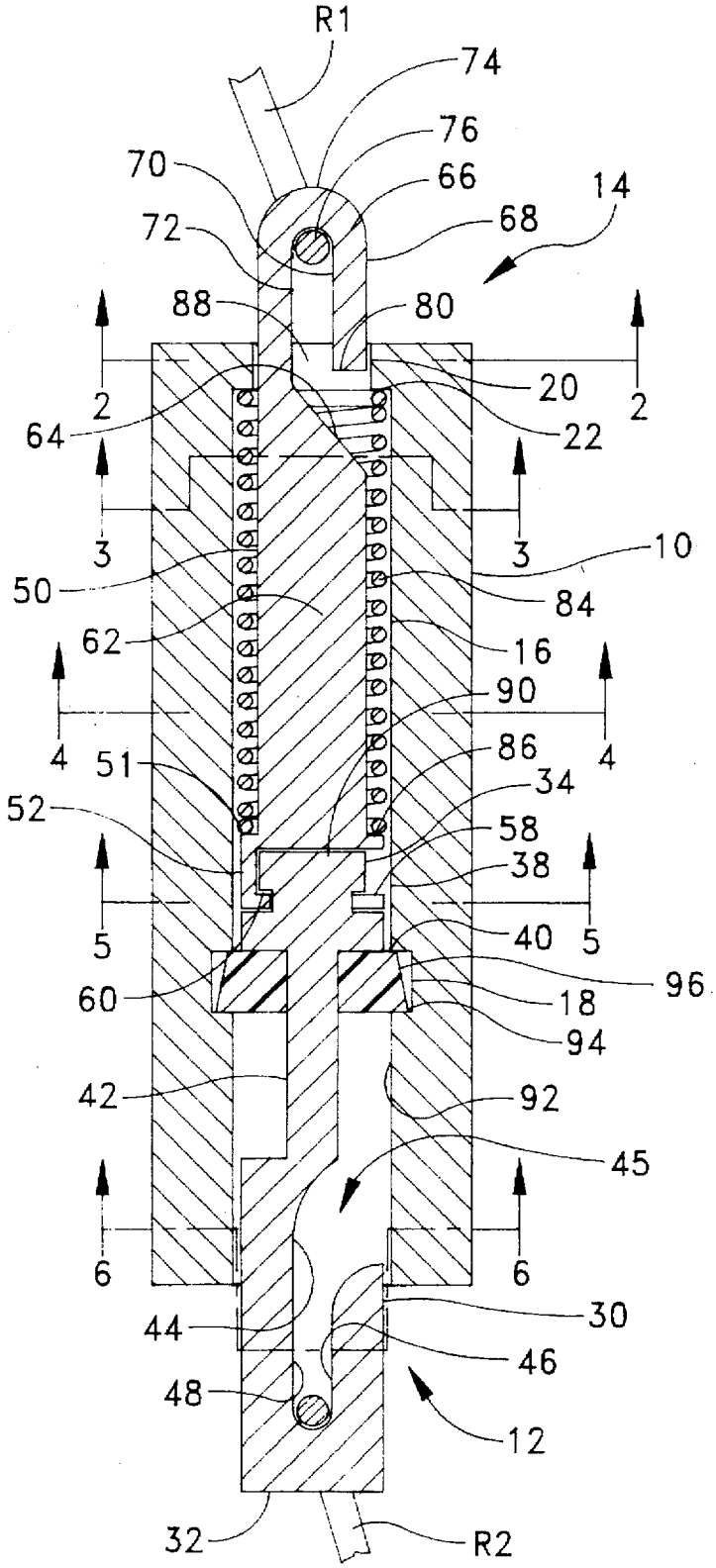
FIG. 1 is a sectional view through the center line of the housing of one embodiment of the invention and showing the assembly in its normally closed position.
Figure 2:
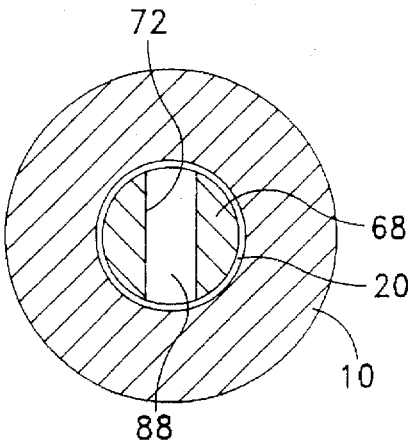
FIG. 2 is a section view of FIG. 1 taken along the line 202 thereof.
Figure 3:
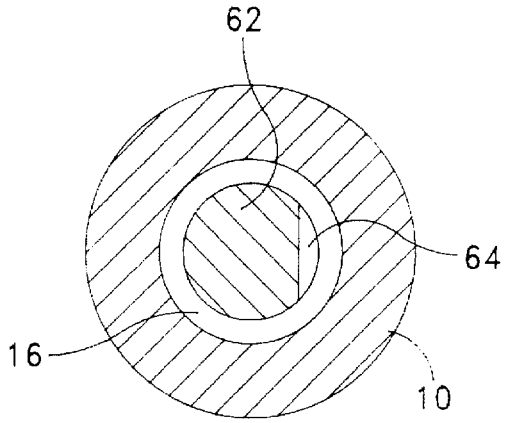
FIG. 3 is a sectional view of FIG. 1 taken along the line 3—3 thereof.
Figure 4:
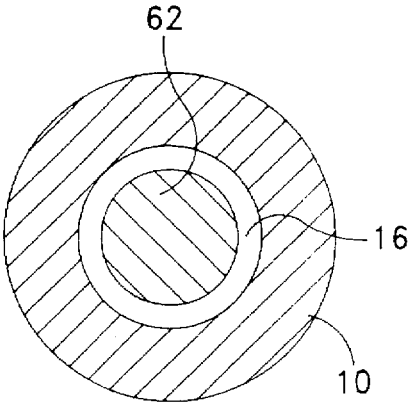
FIG. 4 is a sectional view of FIG. 1 taken along the line 4—4 thereof.
Figure 5:
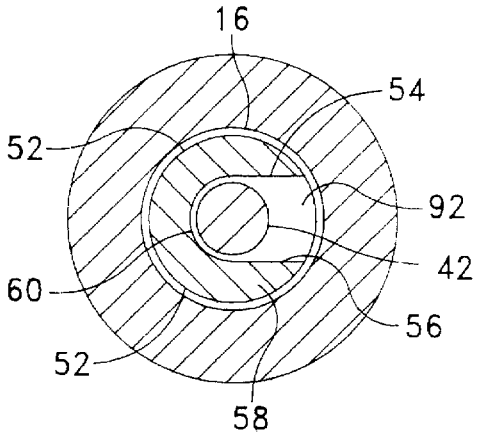
FIG. 5 is a sectional view of FIG. 1 taken along the line 5—5 thereof.
Figure 6:
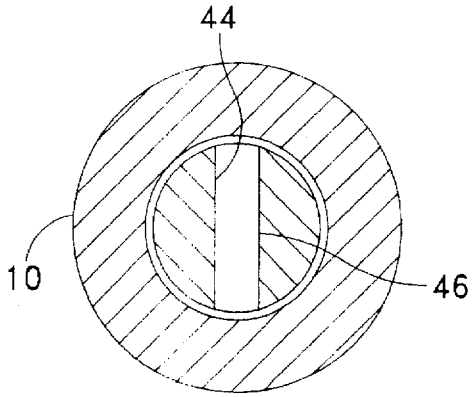
FIG. 6 is a sectional view of FIG. 1 taken along the line 6—6 thereof.

In FIG. 1 are shown housing 10, a second or closed-in-use hook member indicated generally at 12, and an openable-in-use or first hook member indicated generally at 14.

Housing 10 has cylindrical outer and inner surfaces, the main bore or inner surface 16 being interrupted by the notch cylindrical surface 18 and the ledge cylindrical surface 20 adjacent ledge 22.

Closed hook 12 includes a second body having a cylindrical outer surface 30, a planar end 32, cylindrical groove-defining (with surface 30) boss portion 34, cylindrical groove 38, and cylindrical connecting and stop 40 mounted on portion or shaft 42. Interior surfaces 44 and 46 of the hook 12 are planar and connected by a semi-cylindrical surface 48. Access to the interior portions of the hook by which a key ring R2 may be assembled with hook 12 prior to completion of the assembly of the device is via opening 45.

Stop 40 is a polyamide plastic ring with a small peripheral gap (not shown) to permit twisting to open up the gap and assemble the ring grippingly onto reduced diameter carrying portion or shaft 42.

Openable or first hook 14 includes a first body with an elongated cylindrical outer surface 50, a notch-enclosing larger circumferentially interrupted cylindrical surface 52, the lower portion 52 (FIG. 5) of which is omitted between parallel planar wall surfaces 54 and 56 to provide portions of ledge 58 to interact with the facing ledges defined by portions 34 and 30 to restrict relative longitudinal movement between body portions 12 and 14. Surface 52 is coaxial with surface 16, as is surface 60, which merges into planar surfaces 54 and 56. Above ledge 58, and away from surface 52 and from a plane through the center line of the body 62 cutting surface 60 and perpendicular to the paper in FIG. 1, the walls defined by surfaces 52, 54 and 56 are removed. In effect then cooperating surfaces are thus set up between the first and second bodies which surfaces are adapted to contact each other so that both bodies once assembled axially move together. Plane surface 64 connects body 62 with hook 66 having outer cylindrical surface 68, inner planar surfaces 70, 72, outer semi-spherical surface 74 and inner semi-cylindrical surface 76, with plane tip 80 and a first hook opening 88 through which a key ring may be inserted and removed once the device is assembled and thence moved between its normally closed position and its depressed open position.

Hook member 12 is biased away from housing 10 by means of compressed helical spring 84 supported between ledges 22 and 86.

2. Manufacture

In manufacture, spring 84 is first slipped into die cast housing 10, to rest on ledge 22. Next, flexible stop 40 is twisted and assembled onto portion 42. The enlargement 90 is then moved transversely into bore 16 (FIG. 5) to generally align axially die cast members 12 and 14, which are then together then inserted through spring 84, the entry of and bending for passage through hole 92 of stop 40 being facilitated by chamfer 96. Hook 66 partially protrudes through the hole defined by surface 20, the opening 88 to the slot between walls 70, 72 remaining closed by surface 20. Key ring R2 is inserted into the interior of hook 12 prior to such assembly via opening 45 which opening in turn is permanently closed upon assembly by the housing 10 thus assuring permanent attachment of ring R2 to the assembly. Of course, ring R2 could be opened up and removed if desired, but this method of assembly permitted by this device enables the avoidance of opening up this ring for assembly.

It will be noted that shapes and motions are such as to facilitate adapting to automatic machinery should volume production so indicate.

It will also be noted that there is no need of any twisting acts in assembly which is important for avoidance of carpal tunnel syndrome.

3. Operation

In use, each hook member 12 and 14 may be made to support a conventional round (defined by a flat spring steel member with for example two helical turns operable on lateral free end tension to accept keys) key ring.

In ordinary use, the hook member 12 does not move below what is permitted by engagement of the top of stop 40 and the bottom surface of the boss 34, portion 42 being slidable in the central opening of stop 40 which in turn is fixed in position within groove 18.

Hook member 12 is ordinarily biased by spring 84 acting through body 62 on boss portion 34 to urge member 12 to the closed position shown in FIG. 1. The same biasing action and stop also position hook 66 in the closed position shown in FIG. 1.

When it is desired to remove the key ring from hook member 14, the thumb may push against end 32, whereupon shaft 42, freely axially movable relative to the stop 40 and thus housing 10, permits upward movement of hook member 14, against bias of spring 84, a distance sufficient to provide an opening between the top of housing 10 and bottom 80 sufficient to insert or remove the key ring. In effect, the axial movement above described exposes the first hook opening 88 from its normally closed position by the housing 10.

It will be seen that not only is there provided both a hook movable between open and closed positions and one remaining closed in ordinary use, but not just the closed one but both are at all times rotatable relative to both the housing and to each other, providing flexibility and good function.

Figure 7:
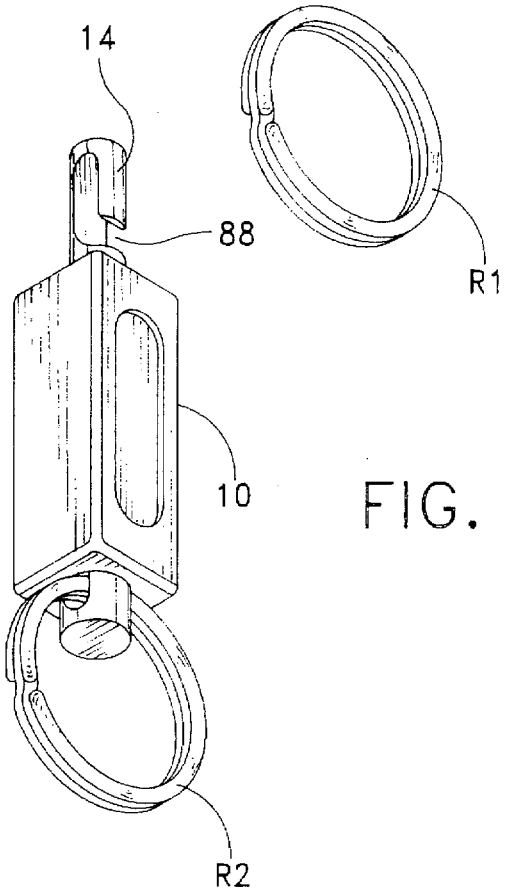
FIG. 7 is a perspective view of an assembled key ring device made in accordance with the present invention showing key rings at both ends thereof and made in accordance with both embodiments of the present invention.
Figure 8:
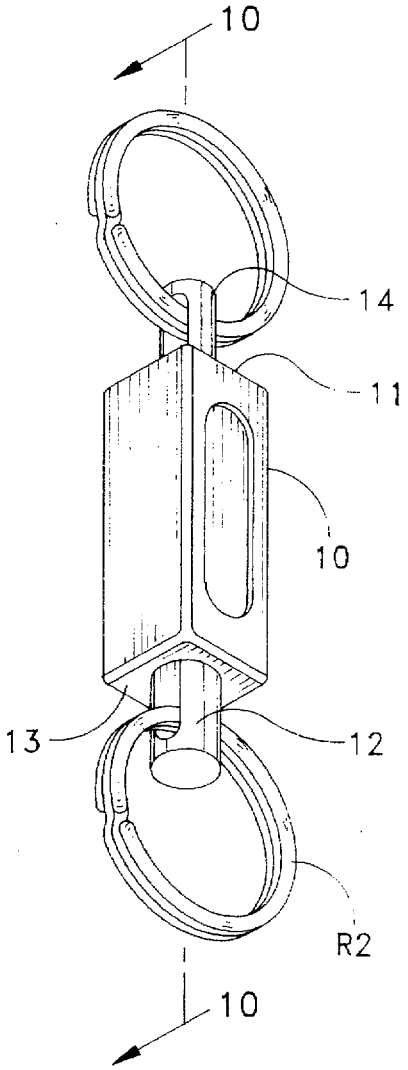
FIG. 8 is a perspective view similar to FIG. 7 but showing the arrangement when the bottom or second end of the device is depressed so as to axially move the first hook portion forwardly to expose the hook entrance/exit such that the retaining ring mounted thereon may be easily removed.
Figure 9:
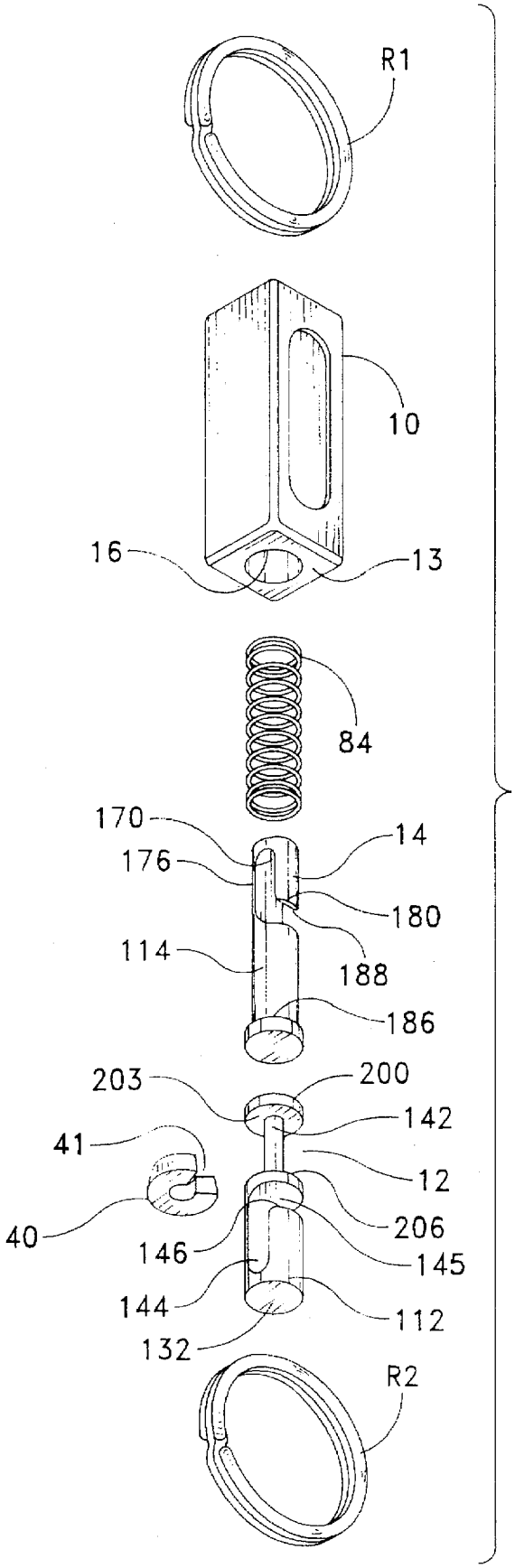
FIG. 9 is an exploded view prior to assembly of the components of a second embodiment of the device.
Figure 10:
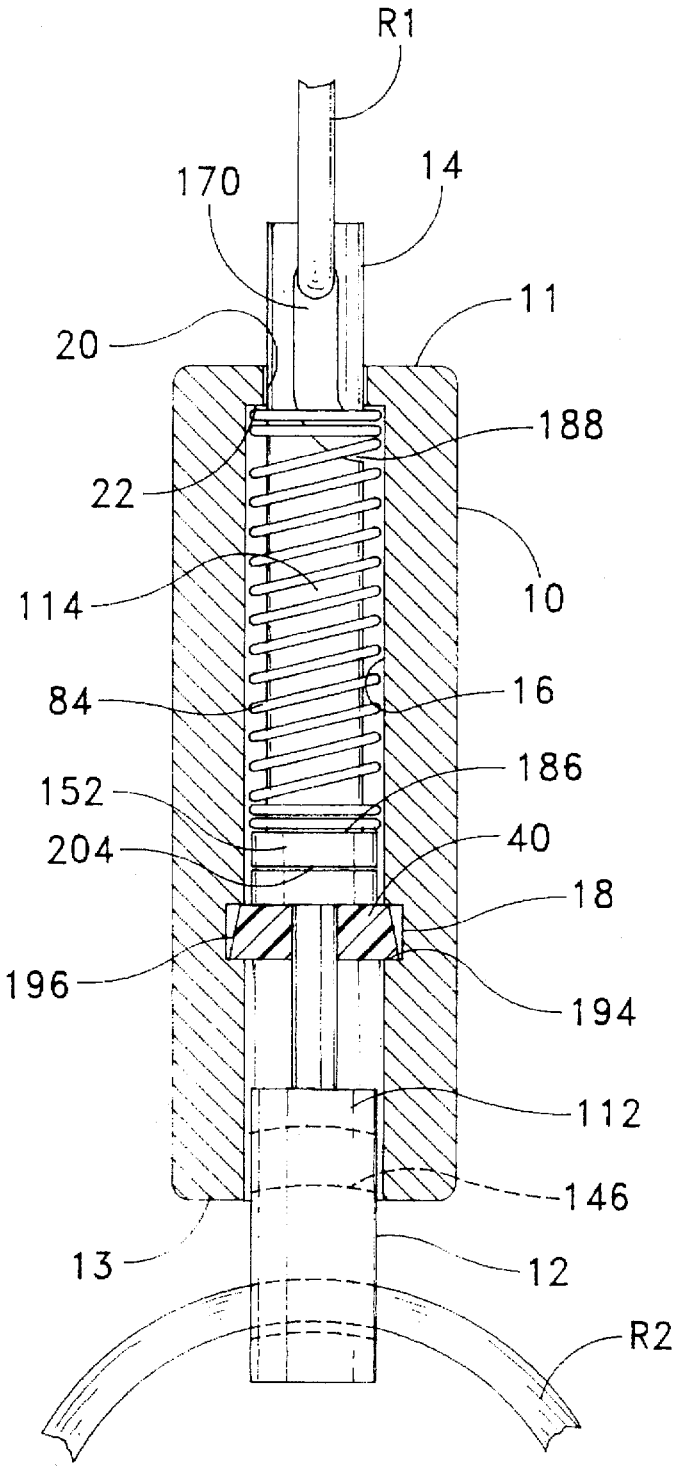
FIG. 10 is a side sectional view along the line 10—10 of FIG. 7 showing the assembled format of the embodiment of the device shown in its normally closed position.
Figure 11:
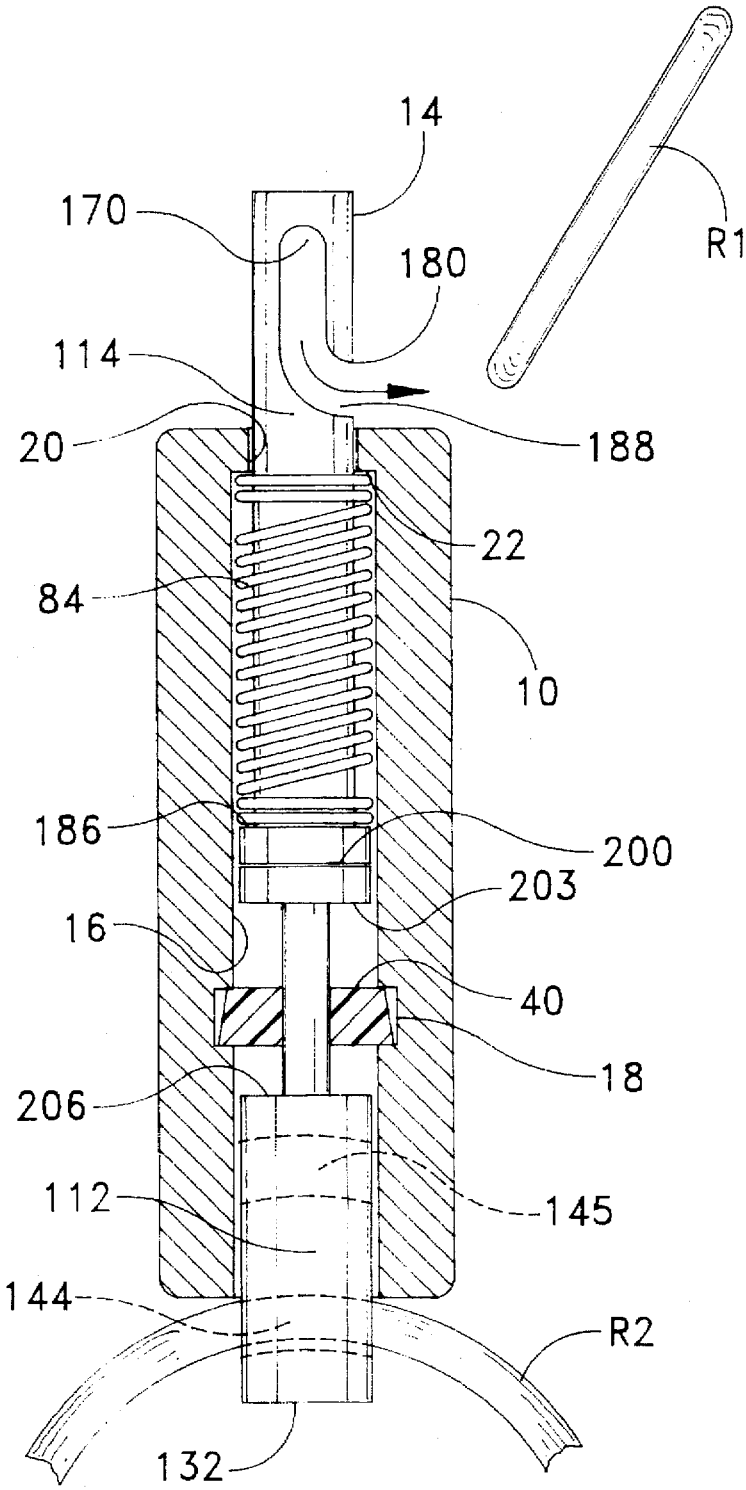
FIG. 11 is a sectional view similar to FIG. 10 but showing the device in its depressed ring release or open position.

With respect to the preferred embodiment of the invention pictured particularly in FIGS. 9 through 11 of the drawings and as also illustrated in FIGS. 7 and 8 which are common to both embodiments, it should be noted that the primary difference between the embodiments rests in the interaction of the first and second bodies and their abutment against each other within the housing. Accordingly referring to FIG. 7, the first hook member 14 is shown protruding from the top 11 of the housing 10 and the second hook member 12 protruding from the bottom 13 thereof. It should also be noted that FIG. 7 shows the normal, that is, the closed position of the first hook 14, and that by pressing the second hook member 12 forwardly or upwardly as shown in the drawings the first hook member 14 moves axially vis-a-vis the housing 10 a distance sufficient to expose the first hook opening 88 and thus facilitate the removal of the first ring R1 from that end of the device. The second ring R2 is, in effect, permanently mounted within the second hook 12.

Referring now particularly to FIG. 10, the housing includes a central bore 16 extending upwardly essentially the entire axial length of the housing 10 but terminating at a stop or shoulder 22 and then via a slightly smaller dimensioned bore 20 outwardly of the housing at the first or top end 11 thereof. The bottom or second end of the housing is essentially open, that is, there are no restrictions such as the ledge 22 at the bottom end of the bore 16. The first and second hook members 14 and 12 respectively are provided with generally cylindrical bodies which are adapted to extend into and be housed by the housing 10. These bodies 114 and 112 are provided with contact surfaces at their forward and rear ends respectively which surfaces abut each other and enable, as will hereinafter be more fully explained, the two bodies and thus the two hook members to move in axial tandem relationship with each other with respect to the housing 10. Obviously in those cases where the bore 16 is cylindrical as are the bodies 112 and 114 which is the preferable situation, then each of the hook members 12 and 14 may also independently rotate within the housing 10 independent of each other and the housing.

Intermediate along the axial extent of the bore 16 is a positioning recess 18 in which a stop or positioning washer 40 is adapted to be positioned thereinto. Such stop washer 40 includes a circumferential opening 41 and is made of a spring compressible material such as Nylon (polyamide) such that it may be compressed to a lesser diameter but will expand when permitted and is configured so as to be snugly received into recess 18 when permitted and thus, as will be more fully explained, provide the means by which the body of the second hook member 12 is limited in its axial travel with respect to the housing 10.

The body 112 of the second hook member 12 is preferably cylindrical at its lower end and is provided with a recessed hook 144 having an opening 145. The lower end of the body 112 is provided with a surface 132 generally planar but which may be rounded or the like such that it forms a convenient surface through which the overall aspects of the invention may be accomplished by depressing one's thumb against such surface to move the first and second bodies 114 and 112 in unison axially via the housing 10. The mid portion of the body 112 is provided with a reduced diameter shaft 142 over which the washer 40 may be positioned, that is, the circular central opening of the washer fitted over the shaft 142. The forward end of the body 112 terminates in an enlarged boss or flange 200 which defines an upper generally planar surface 202 generally of the same diameter as the lower portion of the body 114 and defining a forward abutment surface.

The first hook member 14 is provided at its lower portion with a body 114 preferably of a diameter slightly less than that of the second body 112 and matching the diameter of the bore 20 or slightly less than such so that the hook 176 defined at the forward end thereof can freely move through the bore 20. Such hook 176 includes a recess 170 and an opening 188 through which a key ring R1 or other implement may be placed within the hook 14 or removed therefrom. The lower portion of the body 114 includes an outwardly extending shoulder 152 having a ledge 186 such that a spring 84 may be positioned within the bore 16 and outwardly of the first body 114 between ledges 186 and 22. The bottom of the first body 114 terminates in a relatively planar abutment surface 204 which is adapted to contact the forward abutment surface 200 of the second body 112. Thus through the action of the spring 84 in the assembled normal position of the device as shown in FIG. 10, the spring acts to downwardly force the first body member 114 and through its contact via abutment surfaces 204 and 200, the second body 112 downwardly until the second or lower abutment 203 contacts the upper surface of the positioning ring 40 permanently retained within the recess 18. It should be noted that in this position, both of the hook openings 145 and 188 are, in effect, closed by the housing 10. With respect to the bottom or second hook opening 145, its lower edge 146 is positioned slightly above the lower exit opening of the bore 16 at the lower end 13 of the housing 10; and with respect to the upper or first hook opening 188, its forward edge 180 is positioned slightly below the exit opening of bore 20 at the upper end 11 of the housing. In such positions, the key rings R1 and R2 are non-removable from their respective hooks, and in such position the first and second hook members are adapted to rotationally move with respect to each other and the body 10 such that the general purposes of the device as a key holder may be carried out.

As pointed out previously, the key ring R2 positioned on the lower or second hook member 12 is permanently retained thereon but that the key ring R1 is removable from the first hook 14. In order to accomplish such removal, the button or surface 132 is depressed or moved upwardly as shown in the drawings against the action of the spring 84 until the abutment surface 206 on the top of the main body portion 130 of second body 112 contacts the lower surface of the positioning stop or washer 40—the extent of which travel in effect being determined by the length of the reduced shaft portion 142 minus the thickness of the retaining ring 40 through which it extends and is permitted to axially travel. This travel distance is also dimensioned such that the forward or upward movement as shown in the drawings of the first hook 114 is of an extent to fully expose the first hook opening 188 such that the ring R1 may be removed therefrom or other rings inserted therein. Such distance is also calculated such that second hook opening 145 is not exposed and its key ring R2 permanently retained therein so as to perform one of the other functions of the present invention—that of providing a key ring assembly in which one of the ring or rings is permanently connected to the device while the other ring or rings are easily removable therefrom.

Turning now to the assembly of the device, it will be apparent that no twisting or alignment motion is necessary and that the spring 84 is simply initially loaded into the bore 16 from the bottom thereof and then the first hook member 114 placed therein and then the second hook member with the retaining ring 40 snap engaged to the reduced diameter shaft 142 and the key ring R2 simply inserted into the hook recess 144 via the hook opening 145 also simply inserted into the bottom end of the bore 16 and thence upwardly pushed against the action of the spring 84 until the retaining ring 40 outwardly expands and snaps into the recess 18. It is generally beneficial in assembling the device that a chamfer 196 be provided on the forward end of the spring washer or stop 40 such that the spring washer 40 is compressed during its forward or upward assembly travel in the bore 16 beyond the recess 18 a slight distance so as to properly enable all the components to be aligned and thence under the action of the spring 84 allowed to be downwardly pushed until the non-chamfered lower surface of the washer 40 contacts the ledge 194. It should thus be apparent that the worker assembling the device need not twist, pull open or otherwise engage in possibly wrist or finger damaging movements to place the key ring R2 within the hook recess 144, and that all that is required is simple progressive loading and axial pushing movement. Also, once the device with the key ring R2 has been assembled, the first key ring R1 may be positioned again without any twisting or prying motion on the part of the assembler by simply pushing the button 132 so that the device moves to the position shown in FIG. 11 of the drawings whence the first key ring or rings R1 may be simply inserted into the exposed first hook opening 188 and then the force on the lower hook member 112 via the action against surface 132 withdrawn and the device allowed by action of the spring to return to its assembled non-open position as shown in FIG. 10.

Other Embodiments

The housing exterior cross-section can be as desired: round, square, elliptical, rectangular, teardrop, streamlined or other and the bodies could even in some cases be non-circular which although precluding free rotation would allow for axial movement and those benefits of the device permitted by such axial relative movement.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A double-ended key ring assembly adapted to receive a key retaining ring at each end thereof and wherein one of said rings may be simply removed from the assembly by a relative axial movement thereof comprising, a housing having a body and having a first front end with a first end opening and a second rear end with a second end opening and a longitudinally directed housing body opening extending through said body from said second end to said first end and terminating at opposite ends at said first end and said second end openings, and a ledge only inwardly extending into said housing body opening at said first housing end proximal to said first end opening, a first member having a body with forward and rear ends with a hook and hook opening at said forward end of said first member body and a contact surface at said rear end of said first member body for contacting the front end of a second body member in turn having a body with forward and rear ends with a hook and hook opening at said rear end of said second member body and a first contact surface at said forward end of said second member body, means for retaining and positioning said second member body partially longitudinally within said housing while permitting longitudinal axial movement of said second member a finite distance back and forth within said housing between an open position of said assembly wherein said first member hook opening is exposed outside said housing first end such that a ring mounted in said first hook can be removed therefrom and a closed position wherein said first member hook opening is shielded by said housing and any ring mounted in said first hook cannot be removed therefrom, and a spring for continually urging said first member rearwardly into contact with said first contact surface of said second member and into said closed position, said rear end of said second member body rearwardly outwardly extending from said housing rear end and said second member hook opening shielded by said housing in both said open and closed positions of the assembly and said second member body rear end engageable to axially move said second member and said first member forwardly to said open position against the action of said spring.

2. The assembly of claim 1, wherein said second member body has a reduced width shaft disposed between the forward and rear ends thereof, a retaining member mounted on said reduced width shaft and in turn axially fixedly attached to an outwardly extending recess provided in said housing longitudinally directed opening for fixing the limits of the axial movement of said second member.

3. The assembly of claim 2, wherein said longitudinally directed opening of said housing, both of said first and second member bodies and said reduced width shaft are cylindrical such that both said first and second members are supported in said housing for independent relative rotation with respect to each other and said housing.

4. The assembly of claim 3, said second member body having a second contact surface at the forward end of said second member body rear end and adapted to contact said retaining member so as to limit the forward motion of said second member relative to said housing.

5. The assembly of claim 4, wherein said retaining and positioning means being an expandable split retaining washer having a central opening and positioned in said housing outwardly extending recess and mounted on said reduced width shaft, said washer permitting said shaft to axially move back and forth therethrough so as to provide the joint axial motion of the first and second members with respect to the housing which enables the assembly to move between said open and closed positions.

6. The assembly of claim 5, wherein said retaining washer limits said axial movement of said second member to said finite distance.

7. The assembly of claim 6, wherein the position of said first member hook opening within the confines of said housing is less than said finite distance so as to assure that said first member hook opening is freely exposed outside said housing in said open position.

8. The method of assembling a double-ended key ring assembly adapted to receive a key retaining ring at each end thereof and wherein one of said rings may be simply removed from the assembly by a relative axial movement thereof and which assembly includes a housing having a body and having a first front end with a first end opening and a second rear end with a second end opening and a longitudinally directed housing body opening extending through said body from said second end to said first end and terminating at opposite ends at said first end and said second end openings, and a ledge only inwardly extending into said housing body opening at said first housing end proximal to said first end opening, a first member having a body with forward and rear ends with a hook and hook opening at said forward end of said first member body and a contact surface at said rear end of said first member body for contacting the front end of a second body member in turn having a body with forward and rear ends with a hook and hook opening at said rear end of said second member body and a first contact surface at said forward end of said second member body, means for retaining and positioning said second member body partially longitudinally within said housing while permitting longitudinal axial movement of said second member a finite distance back and forth within said housing between an open position of said assembly wherein said first member hook opening is exposed outside said housing first end such that a ring mounted in said first hook can be removed therefrom and a closed position wherein said first member hook opening is shielded by said housing and any ring mounted in said first hook cannot be removed therefrom, and a spring for continually urging said first member rearwardly into contact with said first contact surface of said second member and into said closed position, said rear end of said second member body rearwardly outwardly extending from said housing rear end and said second member hook opening shielded by said housing in both said open and closed positions of the assembly and said second member body rear end engageable to axially move said second member and said first member forwardly to said open position against the action of said spring, comprising the sequential steps of axially loading said spring into said housing from the second end opening of the housing, thereafter positioning said first member into said housing with the forward end of said first member forwardly projecting into said housing opening, thereafter positioning said second key ring into said second hook and thereafter positioning said second member into said housing with the forward end of said second member projecting forwardly and with the positioning and retaining means positioned thereon, and thereafter continuing to forwardly axially push the second member into said housing until the retaining means is positioned into said recess.

9. The assembly method of claim 8, wherein said second member is initially forwardly pushed into said housing to a position where the retaining means is located forwardly of the recess and then permitting the second member to move rearwardly under the action of the spring means to position said retaining means in said recess.

* * * * *